US012116197B2

(12) United States Patent
Adamczewski

(10) Patent No.: US 12,116,197 B2
(45) Date of Patent: Oct. 15, 2024

(54) BOTTLENECK INSERT

(71) Applicants: Marek Adamczewski, Lodz (PL); Dariusz Zimny, Lodz (PL)

(72) Inventor: Marek Adamczewski, Lodz (PL)

(73) Assignees: Marek Adamczewski, Lodz (PL); Dariusz Zimny, Lodz (PL)

( * ) Notice: Subject to any disclaimer, the term of this patent is extended or adjusted under 35 U.S.C. 154(b) by 3 days.

(21) Appl. No.: 17/800,543

(22) PCT Filed: Feb. 20, 2021

(86) PCT No.: PCT/EP2021/054248
§ 371 (c)(1),
(2) Date: Aug. 18, 2022

(87) PCT Pub. No.: WO2021/175628
PCT Pub. Date: Sep. 10, 2021

(65) Prior Publication Data

US 2023/0074343 A1 Mar. 9, 2023

(30) Foreign Application Priority Data

Mar. 3, 2020 (PL) ..... 433109

(51) Int. Cl.
*B65D 81/32* (2006.01)

(52) U.S. Cl.
CPC ..... *B65D 81/3227* (2013.01); *B65D 2217/00* (2013.01)

(58) Field of Classification Search
CPC ..... B65D 81/3227; B65D 81/3216; B65D 81/3238
USPC ..... 206/221; 215/DIG. 8
See application file for complete search history.

(56) References Cited

U.S. PATENT DOCUMENTS

| | | | | |
|---|---|---|---|---|
| 8,418,865 | B2 * | 4/2013 | Cho | B65D 51/1672 220/521 |
| 2005/0184026 | A1 | 8/2005 | Haley | |
| 2007/0157824 | A1 * | 7/2007 | Cohen | A47J 36/08 99/403 |
| 2008/0166558 | A1 * | 7/2008 | Baran, Jr. | C09C 1/3072 428/403 |
| 2013/0292275 | A1 | 11/2013 | Smart | |
| 2014/0260117 | A1 * | 9/2014 | Farber | A61J 9/00 215/11.4 |
| 2016/0053040 | A1 * | 2/2016 | Fujikawa | C08K 5/372 525/310 |
| 2018/0119553 | A1 * | 5/2018 | Ucasz | B22F 10/00 |

FOREIGN PATENT DOCUMENTS

| | | | |
|---|---|---|---|
| CN | 1706725 | A | 12/2005 |
| CN | 2910818 | Y | 6/2007 |
| DE | 29907339 | U1 | 7/1999 |

(Continued)

*Primary Examiner* — Stephen J Castellano
(74) *Attorney, Agent, or Firm* — Rivka Friedman

(57) ABSTRACT

A bottleneck insert having a cylindrical body; a tube located inside the cylindrical body, wherein the tube is coaxial with the cylindrical body and extends through along the cylindrical body, end wherein the tube is connected to a side wall of the cylindrical body via a base located at a first end of the side wall of the cylindrical body; and a sieve having a form of a circular ring and located between the tube and the side wall of the cylindrical body.

15 Claims, 5 Drawing Sheets

(56) References Cited

FOREIGN PATENT DOCUMENTS

| | | | |
|---|---|---|---|
| EP | 1814794 | A2 | 8/2007 |
| WO | 9002085 | A1 | 3/1990 |
| WO | 2007079200 | A2 | 7/2007 |
| WO | 2009128626 | A2 | 10/2009 |
| WO | 2010131938 | A1 | 11/2010 |

* cited by examiner

BOTTLENECK INSERT

This application is the national stage (Rule 371) of international application No. PCT/EP2021/054248 filed 20 Feb. 2021.

TECHNICAL FIELD

The object of the invention is a bottleneck insert, in particular for a bottle with water.

BACKGROUND

There is a problem of diversifying a flavour of bottled water. There are known flavoured bottled waters, which however, in order to maintain a long shelf life, usually contain various preservatives.

There are known bottle caps containing a powder, which, for example, after twisting the bottle cap onto the bottle, mixes with the water contained therein, to add specific flavour to the water.

However, a noticeable change in the flavour of the whole volume of water contained in a bottle requires a considerable amount of a powdered or fluid substance, which must be contained in the bottle cap and subsequently mixed with the water.

SUMMARY OF THE INVENTION

There is a need to provide a bottleneck insert with a consumable substance which would enable limiting the amount of required consumable substance (flavouring) contained within the insert. It would be advantageous if the insert would provide satisfactory taste sensations when consuming water from the bottle.

There is disclosed herein a bottleneck insert having a cylindrical body. A tube is located inside the body. The tube is coaxial with the body and extends through along the body. The tube is connected to a side wall of the body by means of a base located at a first end of the side wall of the body. A sieve formed as a circular ring is located between the tube and the side wall of the body. Thereby, a container for liquid is formed between the sieve and the base. The container may contain a liquid, such as concentrated fruit juice.

During the consumption of a beverage from the bottle, water (or other beverage) passing across the tube can be directed by the drinking person from the bottle by proper positioning of the lips or the tongue on the sieve, through the openings of which it can come into contact with the liquid from the container (for example, fruit juice). This causes the migration of the flavouring from the liquid in the container to the water in very close vicinity of the tongue of the person drinking from the bottle, and therefore in the vicinity of sensitive taste buds. It also causes taste sensations related to the type of liquid which is placed in the container.

The tube can have an inner diameter s equal from 5 to 25 mm. The smaller the inner diameter s of the tube, the smaller the unit flow of water, and thus the higher the perceivable intensity of flavour, caused by partial mixing of water with the liquid (such as juice) present in the container.

In other words, by changing the inner diameter s of the tube, as well as the size of the openings, it is possible to adjust the desired mixing ratio of water (or other beverage) with the liquid present in the container of the insert, and, as a consequence, the intensity of flavour experienced by the user when consuming the water from the bottle with the insert according to the invention placed inside the neck.

The diameter DO of the openings of the sieve may be from 100 to 500 μm. Therefore, a dense liquid present in the container between the sieve and the base does not flow out of the insert spontaneously, even when the insert has its openings facing down.

The size of the body shall correspond to the inner size of the bottleneck such that it can be conveniently placed inside the neck by press fitting, such that the flow of liquid to the outside of the bottle is only possible via the tube of the insert. For example, the outer surface of the side wall of the body may have a peripheral outer protrusion with a diameter corresponding to the diameter of the neck, wherein the height of the peripheral outer protrusion may be smaller than the height of the whole body, so as to limit the force necessary to press-fit the insert to inside the bottleneck. The outer diameter d of the body is smaller than the diameter D of the peripheral outer body protrusion.

The sieve may be distanced from a second end of the side wall of the body, for example by a distance equal from 1 to 10 mm. A short distance allows a close contact of the mouth or the tongue with the sieve, under which there is juice, which increases the intensity of experiencing the flavour of the juice.

The end of the tube may extend above the second end of the side wall of the body, for example by a distance of x from 0.1 to 3 mm. Due to this, after press fitting the insert inside the bottleneck by tightening the original bottle cap, the end of the tube abuts the inner surface of the bottle cap, preventing the ingress of water into the mixing chamber between the tube and the side wall of the body.

The tube may be further connected to the side wall of the body by means of at least one arm, such as by two, three, four or more arms. The arms are to stiffen the mounting of the tube inside the body.

The insert may further comprise, adjacently to the sieve, a peripheral inner body protrusion on the inner surface of the side wall of the body. The peripheral protrusion constitutes a support element for the sieve, due to which the sieve is prevented from moving into the body. The sieve may be connected to the peripheral protrusion by press fitting.

The thickness g of the sieve in areas distant from the clearance of the openings can be equal from 0.5 to 1.5 mm, while the thickness G of the sieve in areas directly adjacent to the edges of the openings can be slightly larger, for example by a value of 0.05 to 0.2 mm. Larger thickness of the sieve in areas directly abutting the edges of the openings can be achieved by laser cutting to create the openings. During laser cutting, the liquefied material around the laser beam partially flows around the opening, forming peripheral protrusions around the openings.

The distribution of openings in the sieve may be regular or uneven. For example, in one part of the sieve the openings may have a more dense distribution than in another part of the sieve. This allows the user to place the mixing chamber relative to the mouth and the tongue, in a position which better fulfils the needs of the user (less or more intense mixing of water with the liquid from the container).

The openings in the sieve have equal or various sizes. For example, in one part of the sieve the openings may be larger than in another part of the sieve. This also allows the user to place the mixing chamber relative to the mouth and the tongue, in a position which better fulfils the needs of the user (less or more intense mixing of water with the liquid from the container).

A rotatable cover with an access opening may be located on the sieve at the side of the mixing chamber. This may enable the mixing of water with the liquid from the container only within a selected group of openings.

The sieve may be press-fitted between the inner surface of the side wall of the body and the outer surface of the tube to facilitate its easy insertion.

The insert is preferably made of plastic, such as polypropylene, polyamide or polystyrene, which is approved for contact with food.

BRIEF DESCRIPTION OF FIGURES

The invention is shown by means of example embodiments in a drawing, wherein.

DETAILED DESCRIPTION OF EMBODIMENTS

Figure 1:
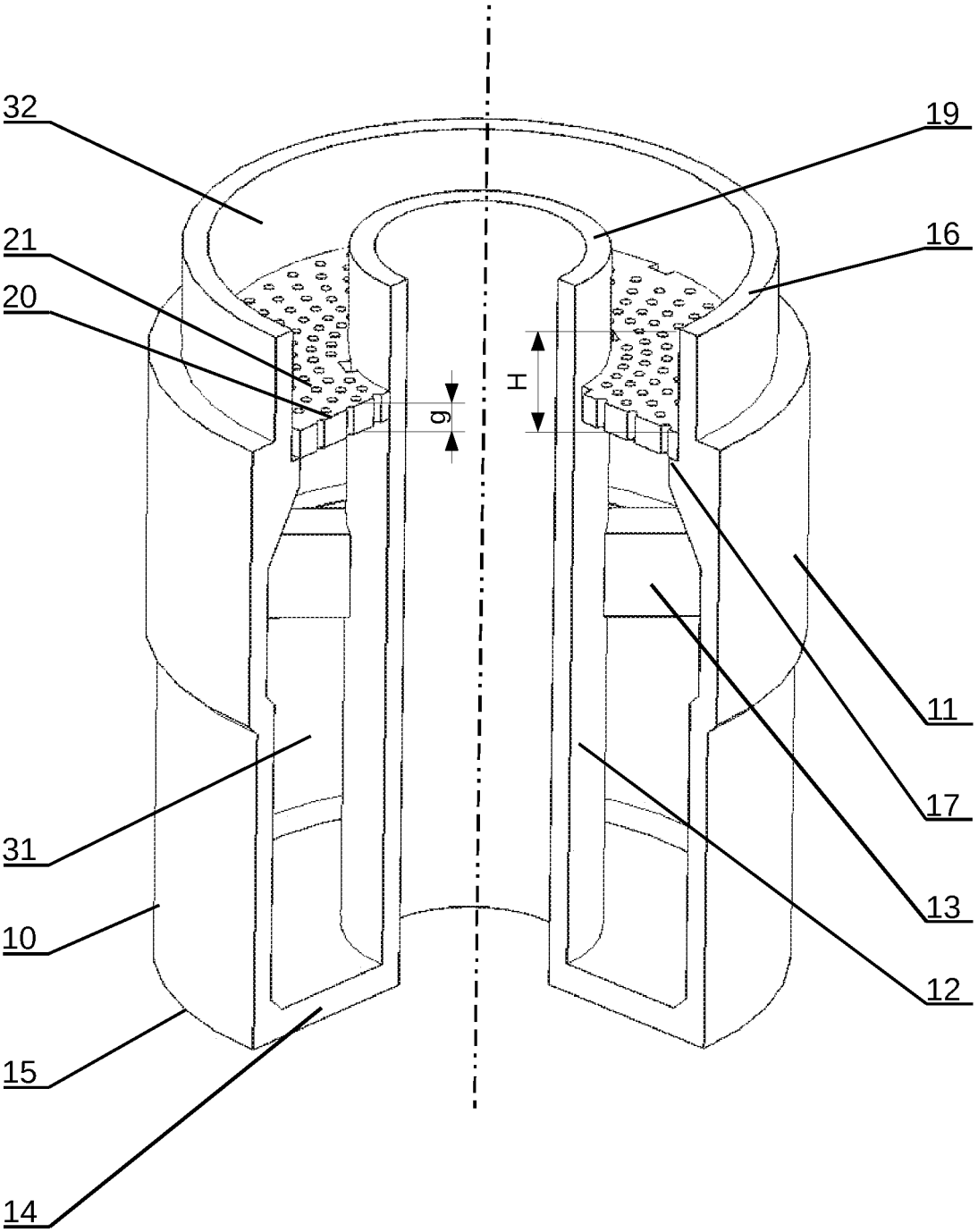
FIG. 1 presents an embodiment of the insert in a partial lengthwise cross-section in an isometric top view.
Figure 2:
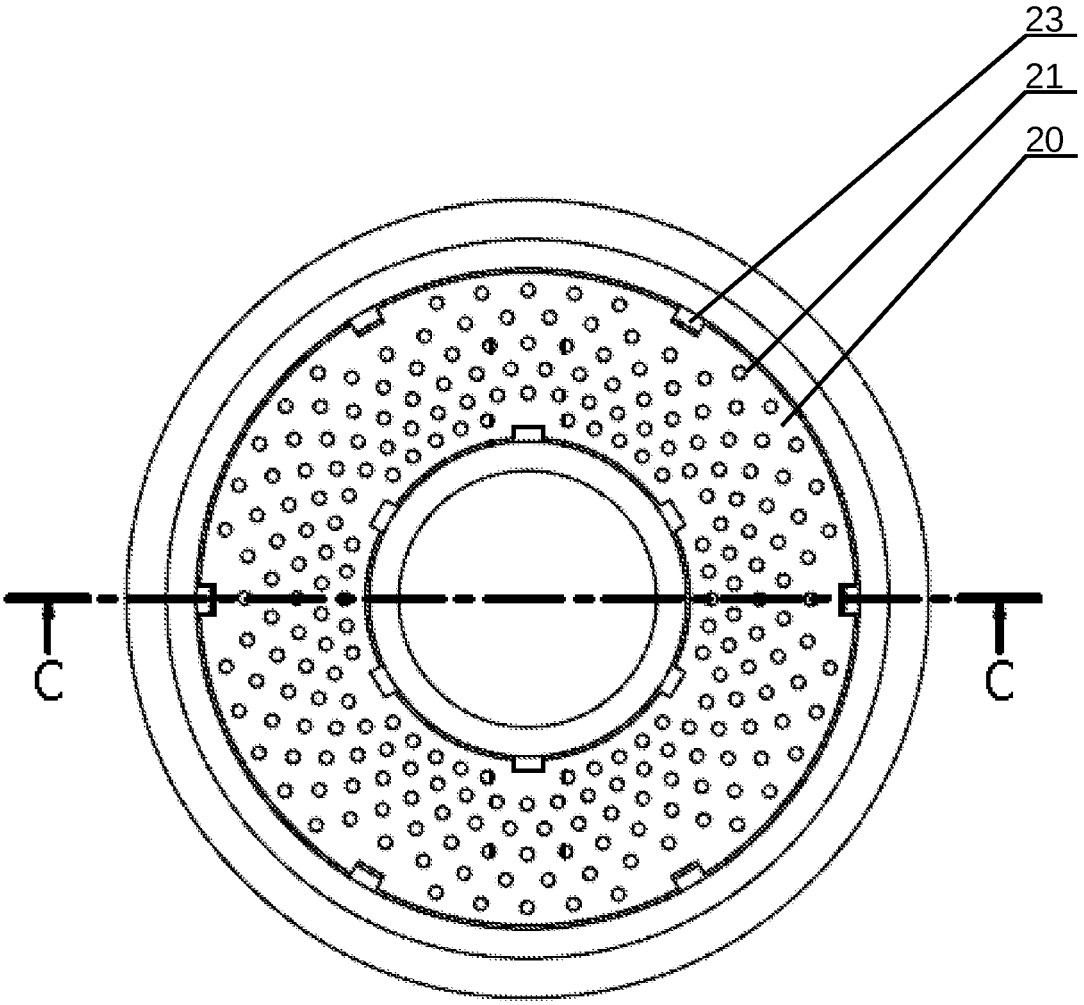
FIG. 2 presents the insert in a top view.
Figure 3:
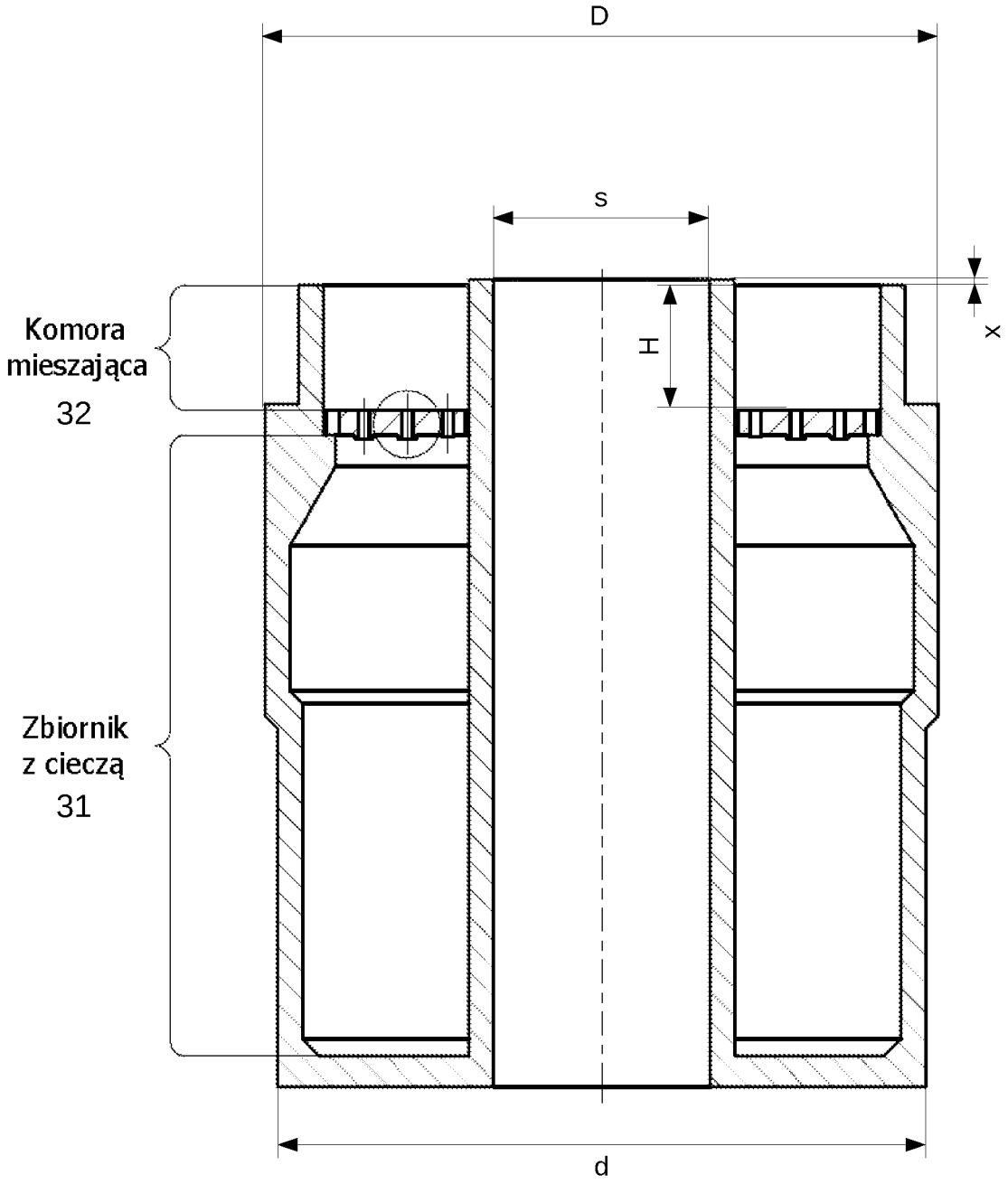
FIG. 3 presents the cross-section C-C of the insert.
Figure 4:
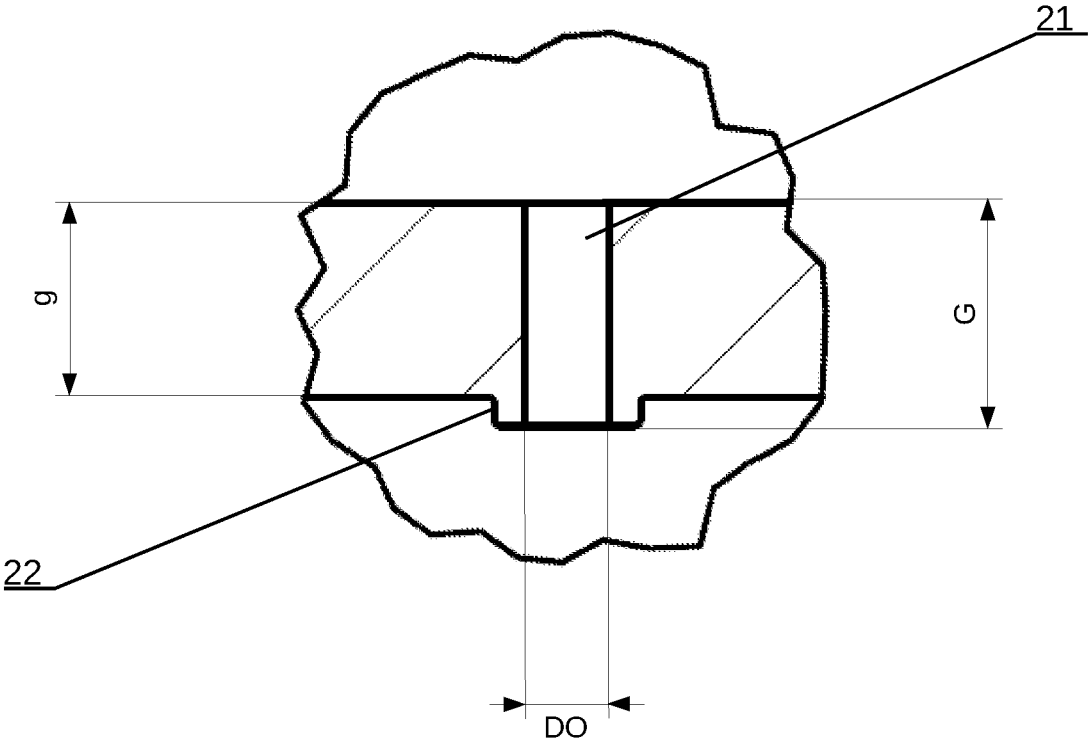
FIG. 4 presents the detail D of FIG. 2.

FIG. 1 presents an embodiment of the bottleneck insert in a partial lengthwise cross-section in an isometric top view. The insert comprises a cylindrical body 10, in which there is located tube 12 located coaxially and extending through along the body 10, wherein the tube 12 is connected to the side wall of the body 10 by means of a base 14 which is located at one of ends 15 of a side wall of the body 10.

The insert comprises a sieve 20 in the shape of a circular ring, with openings 21, located between the tube 12 and the side wall of the body 10. The sieve 20 is located at a distance H from the second end 16 of the side wall of the body 10, forming an open mixing chamber 31 above the sieve 20 and a container 32 for the liquid between the sieve 20 and the base 14.

On the outer and on the inner peripheral edge of the sieve 20 there are recesses 23 which can engage their corresponding protrusions on the inner surface of the side wall of the body 10 and on the outer surface of the tube 12 by press fitting that improve the mounting of the sieve 20 in the body 10.

The outer surface of the side wall of the body 10 has a peripheral outer body protrusion 11, the diameter of which is adjusted to the inner diameter of the bottleneck, enabling the placement of the insert inside the neck by press fitting.

The tube 12 is further connected to the side wall of the body 10 by means of two arms 13.

On the inner surface of the side wall of the body 10 there is a peripheral inner body protrusion 17, to which the sieve 20 is adjacent and press-fit.

The tube 12 protrudes by a distance x of about 0.5 mm above the second end 16 of the side wall of the body.

Figure 5A:
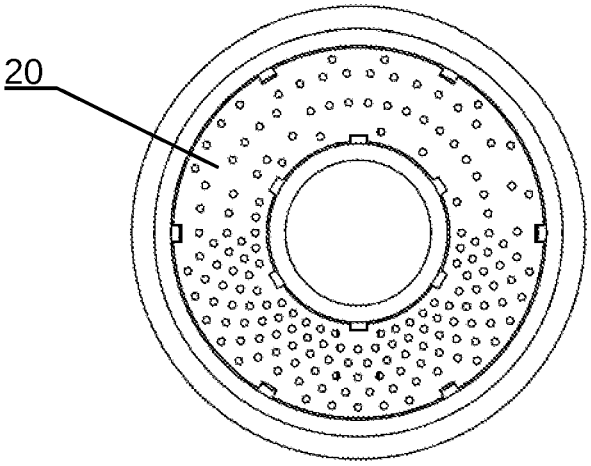
FIG. 5A presents one example of configuration of the openings of a sieve.
Figure 5B:
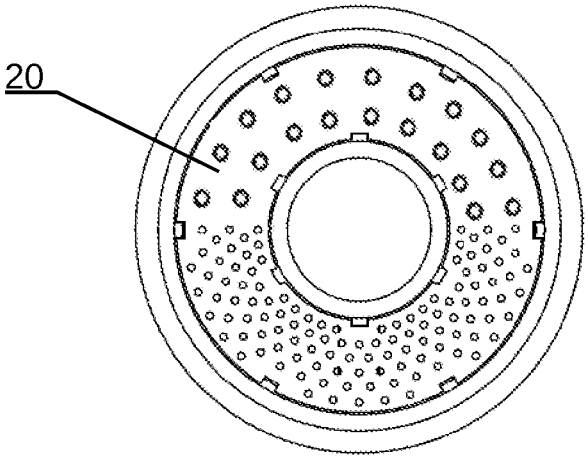
FIG. 5B presents another example of configuration of the openings of a sieve.

As presented in FIG. 5A, in one part of the sieve the openings has a more dense distribution than in another part of the sieve. For example, as presented in FIG. 5B, in one part of the sieve the openings is larger than in another part of the sieve.

Figure 6:
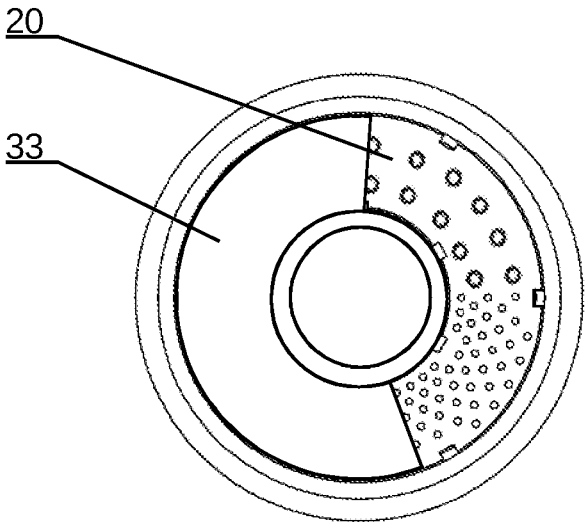
FIG. 6 presents the sieve with a cover.

FIG. 6 presents an example of a rotatable cover 33 with an access opening that can be put on the sieve 20 from the side of the mixing chamber 31. The cover 33 has the shape of an incomplete ring, which can be rotated, covering a portion of the openings 21 of the sieve 20.

The invention claimed is:

1. A bottleneck insert comprising:

a cylindrical body;

a tube located inside the cylindrical body, wherein the tube is coaxial with the cylindrical body and extends through along the cylindrical body, and wherein the tube is connected to a side wall of the cylindrical body via a base located at a first end of the side wall of the cylindrical body; and a sieve having a form of a circular ring and located between the tube and the side wall of the cylindrical body, and wherein an outer surface of the side wall of the body (10) has a peripheral outer protrusion (11).

2. The bottleneck insert according to claim 1, wherein the sieve has openings of a diameter from 100 to 500 μm.

3. The bottleneck insert according to claim 1, wherein the sieve is distanced from a second end of the side wall of the cylindrical body.

4. The bottleneck insert according to claim 3, wherein the sieve is distanced from the second end of the side wall of the cylindrical body by a distance equal from 1 to 10 mm.

5. The bottleneck insert according to claim 1, wherein an end of the tube extends above a second end of the side wall of the cylindrical body.

6. The bottleneck insert according to claim 1, wherein the tube is further connected to the side wall of the cylindrical body by means of at least one arm.

7. The bottleneck insert according to claim 1, further comprising, adjacently to the sieve, a peripheral inner body protrusion on an inner surface of the side wall of the cylindrical body.

8. The bottleneck insert according to claim 1, wherein a container for liquid is formed between the sieve and the base, and wherein the container comprises a liquid.

9. The bottleneck insert according to claim 8, wherein the liquid is a concentrated fruit juice.

10. The bottleneck insert according to claim 1, wherein the sieve has unevenly distributed openings.

11. The bottleneck insert according to claim 1, wherein the sieve has openings of various sizes.

12. The bottleneck insert according to claim 1, further comprising a rotatable cover having an access opening, wherein the rotatable cover is located on the sieve.

13. The bottleneck insert according to claim 1, wherein the sieve is press-fitted between an inner surface of the side wall of the cylindrical body and an outer surface of the tube.

14. A bottleneck insert comprising:

a cylindrical body;

a tube located inside the body, coaxial with the body and extending through along the body, wherein the tube is connected to a side wall of the body by means of a base located at a first end of the side wall of the body; and a sieve formed as a circular ring and located between the tube and the side wall of the body, and wherein an end of the tube extends above a second end of the side wall of the cylindrical body.

15. A bottleneck insert comprising:

a cylindrical body;

a tube located inside the body, coaxial with the body and extending through along the body, wherein the tube is connected to a side wall of the body by means of a base located at a first end of the side wall of the body; and a sieve formed as a circular ring and located between the tube and the side wall of the body, and wherein the tube is further connected to the side wall of the body by means of at least one arm.

* * * * *